United States Patent [19]

DeRosa

[11] Patent Number: 5,074,695

[45] Date of Patent: Dec. 24, 1991

[54] WRITING IMPLEMENT AND CLIP FOR WRITING IMPLEMENT HAVING AN ARM MOUNTED MAGNIFYING LENS

[76] Inventor: Anthony DeRosa, 206 Chester St., East Hartford, Conn. 06108

[21] Appl. No.: 565,634

[22] Filed: Aug. 10, 1990

[51] Int. Cl.[5] ..... B43K 29/00

[52] U.S. Cl. ..... 401/195; 359/809; 401/52

[58] Field of Search ..... 401/52, 195; 350/243, 350/244

[56] References Cited

U.S. PATENT DOCUMENTS

| | | | |
|---|---|---|---|
| 1,216,209 | 2/1917 | Callahan | 350/243 |
| 1,377,578 | 5/1921 | Harris | 401/195 X |
| 1,884,968 | 10/1932 | Bloch . | |
| 2,100,239 | 11/1937 | Carlton . | |
| 2,718,749 | 9/1955 | Florman | 401/195 X |
| 3,428,286 | 2/1969 | Del Pesco . | |
| 3,512,875 | 5/1970 | Viollet | 350/243 |
| 3,955,884 | 5/1976 | Del Pesco, Sr. . | |
| 4,398,800 | 8/1983 | Hayes | 350/243 X |

FOREIGN PATENT DOCUMENTS

| | | | |
|---|---|---|---|
| 355556 | 6/1922 | Fed. Rep. of Germany | 350/244 |

*Primary Examiner*—Steven A. Bratlie
*Attorney, Agent, or Firm*—Robert S. Smith

[57] ABSTRACT

A writing instrument which includes an elongated barrel, an elongated spring member for gripping an associated pocket, apparatus for securing a first axial extremity of the elongated spring member to the elongated barrel, a magnifying lens, an elongated arm carrying the magnifying lens at a first axial extremity thereof and apparatus connecting the second axial extremity of the elongated arm to the second axial extremity of the elongated spring member. In other forms of the invention a clip is provided for holding an associated writing instrument having an elongated barrel in an associated pocket. The clip includes a magnifying lens mounted on the clip in the same general manner.

14 Claims, 1 Drawing Sheet

WRITING IMPLEMENT AND CLIP FOR WRITING IMPLEMENT HAVING AN ARM MOUNTED MAGNIFYING LENS

BACKGROUND OF THE INVENTION

The invention relates to writings implements, and to clips for holding implements in the pocket of the user, and magnifying lenses. More particularly the invention relates to the combination of these elements. It will be understood that the invention has application to clips incorporating a magnifying lens as well as to pens and pencils which have such clips integrally formed therewith.

The prior art includes apparatus such as that shown in U.S. Pat. Nos. 3,955,884; 2,100,239; 1,884,968; and 3,428,286. The U.S. Pat. No. 3,955,884 show an apparatus which is much more complex and bulky as well as expensive to manufacture. It will be further understood that magnifying lenses are commercially available mounted in annular rings provided with arms that extend generally radially.

It is an object of the invention to provide apparatus which is compact.

Another object of the invention is to provide an apparatus which is simple and inexpensive to manufacture and to assemble.

It is an object of the invention to provide a mounting for a magnifying lens as well as for convenient utilization of the magnifying lens without substantially increasing the bulk of the apparatus, the expense in manufacturing or the expense involved in assembling the apparatus in accordance with the invention.

SUMMARY OF THE INVENTION

It has now been found that these and other objects of the invention may be attained in a writing instrument which includes an elongated barrel, an elongated spring member for gripping an associated pocket, means for securing a first axial extremity of the elongated spring member to the elongated barrel, a magnifying lens, an elongated arm carrying the magnifying lens at a first axial extemity thereof and means connecting the second axial extremity of the elongated arm to the second axial extremity of the elongated spring member.

In some forms of the writing implement in accordance with the invention the means pivotally connecting comprises a generally round pivot member. The pivot member may be a rivet or a nut and bolt assembly.

In other forms of the invention a clip for holding an associated writing instrument having an elongated barrel in an associated pocket includes means for engaging the associated elongated barrel, and an elongated spring member dimensioned and configured for gripping a pocket. The elongated spring member has a first axial extremity and a second axial extremity and the apparatus includes means for securing the first axial extremity of the elongated spring member to the means for engaging the associated elongated barrel. The apparatus also includes a magnifying lens, an elongated arm having a first axial extremity and a second axial extremity. The elongated arm carries the magnifying lens at the first axial extremity thereof and means are provided for pivotally connecting the second axial extremity of the elongated arm to the second axial extremity of the elongated spring clip.

BRIEF DESCRIPTION OF THE DRAWING

The invention will be better understood by reference to the accompanying drawing in which.

DESCRIPTION OF THE PREFERRED EMBODIMENT

Figure 2:
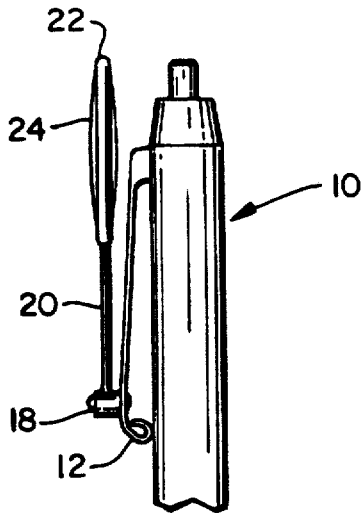
FIG. 2 is a side elevational view of the same writing implement having a spring clip for engaging the pocket of a user and a pivotally mounted mirror in accordance with one form of the invention.
Figure 1:
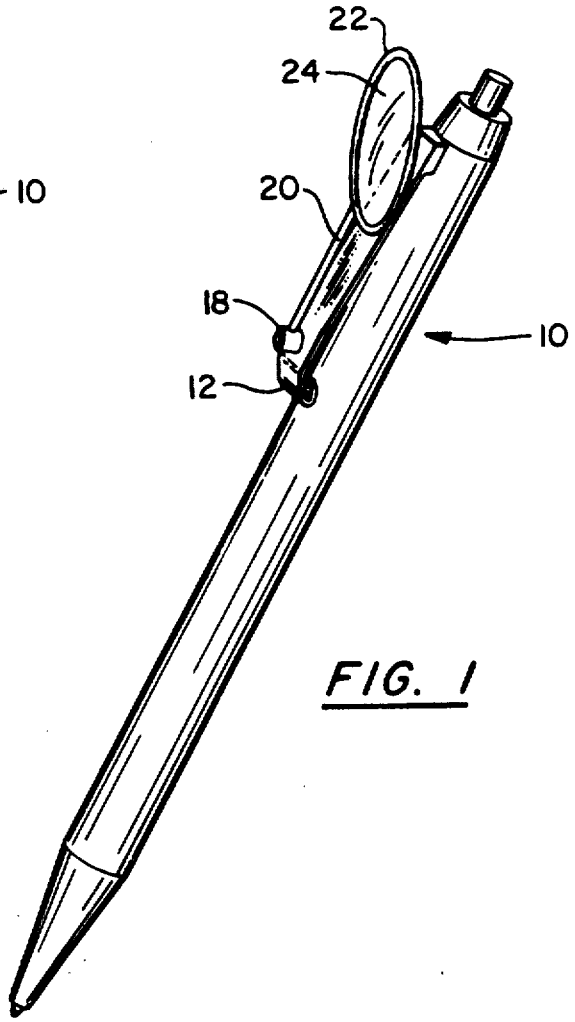
FIG. 1 is a perspective view of a writing implement having a spring pocket clip together with a pivotally mounted magnifying lens attached to the spring clip.
Figure 3:
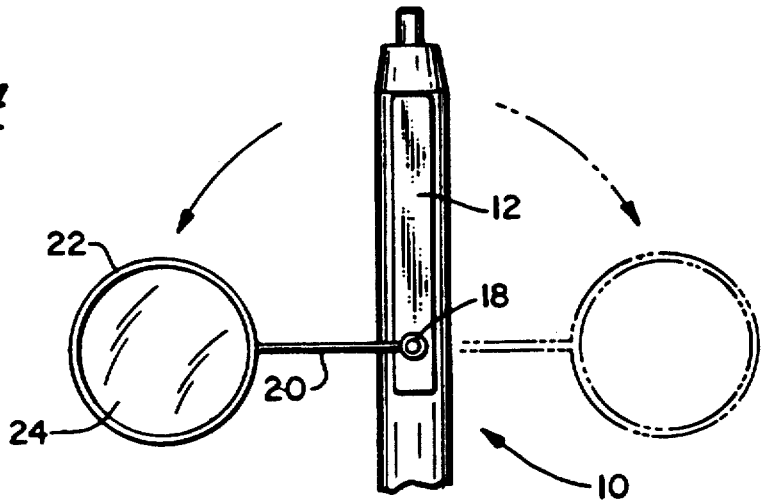
FIG. 3 is a front elevational view of a portion of the apparatus of FIG. 2.

Referring now to FIGS. 1, 2, and 3 there is shown a writing implement 10 on which is disposed an elongated spring clip 12 for engaging the pocket of the user in accordance with one form of the invention. In this embodiment the upper (as viewed) axial extremity of the spring clip 12 will typically be secured to the upper (as viewed) axial extremity of the body or barrel of the writing implement 10 by means of a weld or annular member (not shown) that fits intermediate axial portions of the writing implement.

The lower (as viewed) axial extremity of the spring clip 12 cooperates with a pivot member 18 which secures an arm 20 thereto for relatively pivotal motion in a plane which is essentially parallel to a plane which is disposed in tangential relationship to the barrel of the pen writing implement 10.

Disposed at the free end of the arm 20 is ring 22 that retains a magnifying lens 24. The elongated arm may be pivoted in a plane that is parallel to a plane which is tangential to the generally cylindrical barrel of the pen 10. Thus, the user can easily turn the arm and mirror assembly to a convenient viewing position. It will be understood that the apparatus in accordance with the present invention has utility both for use with existing pens and pencils as well as for pens and pencils on which the complete assembly is integrally formed.

Figure 4:
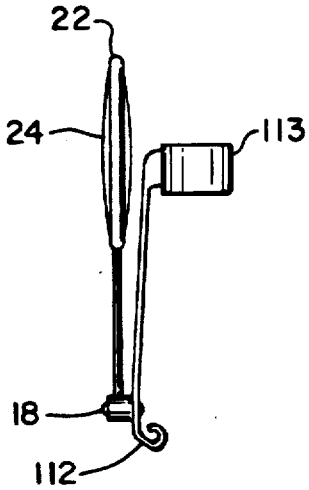
FIG. 4 is a side elevational view of another embodiment of the invention in which a discrete clip on which a magnifying lens is carried is on the elongated spring portion thereof.

More specifically, there is shown in FIG. 4 an embodiment of the invention intended to be installed on any existing pen or pencil. This embodiment includes an elongated spring clip 112 that includes cylindrical section elements 113 for gripping the barrel of an associated writing-implement. In all other respects the apparatus is essentially the same.

It will be understood that an alternative embodiments various magnifying lenses may be utilized. In various embodiments may be a rivet or a nut and bolt assembly. The elongated arm on which the lens is mounted and the elongated spring member may have substantially the same lengths.

The invention has been described with reference to its illustrated preferred embodiment. Persons skilled in the art of such devices may upon exposure to the teaching herein, conceive other variations. Such variations are deemed to be encompassed by the disclosure, the invention being delimited only by the following claims.

Having thus described my invention, I claim:

1. A writing instrument which comprises:

an elongated barrel;

an elongated spring member dimensioned and configured for gripping a pocket, the elongated spring member having a first axial extremity and a second axial extremity;

means for securing the first axial extremity of the elongated spring member to the elongated barrel;

a magnifying lens;

an elongated arm having a first axial extremity and a second axial extremity, the elongated arm carrying the magnifying lens at the first axial extremity thereof; and means pivotally connecting the second axial extremity of the elongated arm to the second axial extremity of the elongated spring clip.

2. A writing implement as described in claim 1 wherein:

the means pivotally connecting comprises a pivot member which has at least an axial section which is generally cylindrical in shape.

3. A writing implement as described in claim 2 wherein:

the pivot member comprises a rivet.

4. A writing implement as described in claim 2 wherein:

the pivot member comprises a nut and bolt assembly.

5. A writing implement as described in claim 2 wherein:

the elongated arm and the elongated spring member have substantially the same lengths.

6. A writing implement as described in claim 5 wherein:

the elongated arm pivots in a plane which is generally parallel to a plane extending generally tangentially to the barrel.

7. A clip for holding an associated writing instrument having an elongated barrel in an associated pocket which comprises:

means for engaging the associated elongated barrel;

an elongated spring member dimensioned and configured for gripping a pocket, the elongated spring member having a first axial extremity and a second axial extremity;

means for securing the first axial extremity of the elongated spring member to the means for engaging the associated elongated barrel;

a magnifying lens;

an elongated arm having a first axial extremity and a second axial extremity, the elongated arm carrying the magnifying lens at the first axial extremity thereof; and means pivotally connecting the second axial extremity of the elongated arm to the second axial extremity of the elongated spring clip.

8. A writing implement as described in claim 7 wherein:

the means pivotally connecting comprises a pivot member which has at least an axial section which is generally cylindrical in shape.

9. A writing implement as described in claim 8 wherein:

the pivot member comprises a rivet.

10. A writing implement as described in claim 8 wherein:

the pivot member comprises a nut and bolt assembly.

11. A writing implement as described in claim 8 wherein:

the elongated arm and the elongated spring member have substantially the same lengths.

12. A writing implement as described in claim 9 wherein:

the elongated arm and the elongated spring member have substantially the same lengths.

13. A writing implement as described in claim 10 wherein:

the elongated arm and the elongated spring member have substantially the same lengths.

14. A writing implement as described in claim 7 wherein:

the elongated arm pivots in a plane which is generally parallel to a plane extending generally tangentially to the barrel.

* * * * *